US006597089B2

(12) United States Patent
Matsutani

(10) Patent No.: US 6,597,089 B2
(45) Date of Patent: Jul. 22, 2003

(54) SPARK PLUG FOR INTERNAL COMBUSTION ENGINE

(75) Inventor: Wataru Matsutani, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 74 days.

(21) Appl. No.: 09/742,384

(22) Filed: Dec. 22, 2000

(65) Prior Publication Data

US 2001/0005109 A1 Jun. 28, 2001

(30) Foreign Application Priority Data

Dec. 22, 1999 (JP) ..... 11-364101

(51) Int. Cl.[7] ..... H01T 13/20; H01T 21/02
(52) U.S. Cl. ..... 313/141; 445/7
(58) Field of Search ..... 313/141, 142, 313/143, 124, 125, 131 A, 139, 18

(56) References Cited

U.S. PATENT DOCUMENTS 5,440,198 A * 8/1995 Oshima et al. ..... 313/141
5,461,275 A * 10/1995 Oshima ..... 123/169 EL
5,866,972 A * 2/1999 Matsubara et al. ..... 313/141
5,877,584 A * 3/1999 Kato et al. ..... 313/141
5,929,556 A * 7/1999 Matsubara et al. ..... 313/139
5,973,443 A * 10/1999 Chang et al. ..... 313/141
5,977,695 A * 11/1999 Osamura et al. ..... 313/141
6,064,144 A * 5/2000 Knoll et al. ..... 313/138
6,078,129 A * 6/2000 Gotou et al. ..... 313/141
6,093,071 A * 7/2000 Osamura et al. ..... 445/7
6,215,235 B1 * 4/2001 Osamura ..... 313/141
6,316,868 B1 * 11/2001 Ishino et al. ..... 313/123
6,337,533 B1 * 1/2002 Hanashi et al. ..... 313/140

FOREIGN PATENT DOCUMENTS

| | | |
|---|---|---|
| EP | 0 872 928 A | 10/1998 |
| JP | 3-98279 | 4/1991 |
| JP | 4-366580 | 12/1992 |
| JP | 9-7733 | 1/1997 |
| JP | 11-3765 | 1/1999 |

* cited by examiner

*Primary Examiner*—Don Wong
*Assistant Examiner*—Minh D A
(74) *Attorney, Agent, or Firm*—Sughrue Mion, PLLC

(57) ABSTRACT

A spark plug including a center electrode which extends in the axial direction and is composed of a body and an electrode whose root end is joined to the end face of the body. The distance between a joined portion of the body and the electrode tip and the face of a free end of the electrode tip is at least 0.15 mm, particularly at least 0.2 mm. A diametral dimension of the electrode tip measured at a position located at the interface between the electrode tip and the joined portion and nearest to the free end of the electrode tip is at least 0.2 mm, particularly at least 0.25 mm, greater than a diametral dimension of the electrode tip measured at the free end. The spark plug suppresses lateral consumption of the electrode tip arising in the vicinity of a joined portion formed through welding.

8 Claims, 2 Drawing Sheets

SPARK PLUG FOR INTERNAL COMBUSTION ENGINE

BACKGROUND OF THE INVENTION

1. Field of the Invention

The present invention relates to a spark plug for an internal combustion engine. More particularly, the invention relates to a spark plug having an electrode tip welded onto a center electrode, improved in preventing or suppressing abnormal lateral consumption or rather spark erosion that occurs at a lateral periphery of the electrode tip and/or at the joined potion that joins the electrode tip and the center electrode.

2. Description of the Related Art

The electrode tip which constitutes part of a center electrode of a spark plug is laser welded to the end face of the body of the center electrode. The body is formed from nickel or a nickel alloy. When an electrode tip formed from a noble metal, such as iridium, is used, a joined portion is formed from an alloy which contains the noble metal, such as iridium, and a large amount of nickel. This alloy exhibits good release of thermions as compared with a noble metal, such as iridium. Thus, when a discharge portion and the joined portion are located in the same vicinity, sparks tend to jump toward the joined portion. As a result, the electrode tip tends to suffer abnormal lateral consumption arising in the vicinity of the joined portion and/or at the joined portion, potentially resulting in dropout of the electrode tip.

According to Japanese Patent Application Laid-Open (kokai) No. 11-3765, when the thickness of a fused portion (joined portion) of an electrode tip as measured at a position located half the radius of the electrode tip away in a radial direction from the axis of the electrode tip is not less than 0.2 mm, a spark plug of sufficient durability is obtained. However, when an electrode tip having a diameter of not greater than 1 mm, particularly not greater than 0.6 mm, is laser welded, sufficient spacing, particularly in the radial direction, cannot be established between a discharge portion and the fused portion, unavoidably resulting in abnormal lateral consumption of the electrode tip arising in the vicinity of the fused portion. When the spark plug is actually used in an engine, the electrode tip may come off, and the life may become shorter than an initially set value.

SUMMARY OF THE INVENTION

It is therefore an object of the present invention to solve the above-mentioned problems involved in a conventional spark plug, and to provide a spark plug for an internal combustion engine in which a discharge portion and a joined portion are located as far away from each other as possible in the diametral and axial directions of an electrode tip which constitutes part of a center electrode thereof, thereby, in particular, suppressing abnormal lateral consumption or lateral spark erosion of the electrode tip arising in the vicinity of the joined portion and/or at the joined portion, and thus maintaining excellent performance over a long period of time.

A spark plug for an internal combustion engine according to the invention comprises a center electrode which extends in the axial direction and comprises a body and an electrode whose root end is joined to the end face of the body. The spark plug is characterized in that the distance between a joined portion formed from an alloy which contains a component of the body and a component of the electrode tip and the face of a free end of the electrode tip is at least 0.15 mm, and that the diametral dimension of the electrode tip as measured at a position located on the interface between the electrode tip and the joined portion and nearest to the free end of the electrode tip is at least 0.2 mm greater than the diametral dimension of the electrode tip as measured at the free end. In general, this invention provides a structure of an electrode tip that is welded onto a top of the center electrode, improving spark-durability performance and suppressing a lateral-park erosion that becomes more critical to a smaller diametral tip welded on a larger-diameter center electrode.

The above-mentioned "body" is usually formed from nickel or a nickel alloy. The material of the above-mentioned "electrode tip" is not particularly limited, and the electrode tip may be formed from platinum or a platinum alloy, such as a Pt—Ir alloy or a Pt—Ni alloy, or from iridium or an iridium alloy, such as an Ir—Rh alloy, an Ir—Pt alloy, or an Ir—Ni alloy.

No particular limitations are imposed on the material and structure of other component members of the spark plug; i.e., an insulator disposed in contact with the circumferential surface of the body; a metallic shell disposed in contact with the insulator from outside; an outer electrode disposed such that a root end thereof is connected to the metallic shell and that a free end thereof faces the center electrode; and a metallic terminal member connected to the center electrode and disposed at the rear end side of the insulator.

The electrode tip is usually joined to the body by laser welding. The circumferential edge of an end face of the body and the circumferential edge of a root end of the electrode tip are fused together, thereby forming the above-mentioned "joined portion" which contains a component of the body and a component of the electrode tip. The end face of the body to which the electrode tip is joined is not limited to a flat face, but may assume the form of a recess, into which the electrode tip is fitted, followed by joining.

The distance between the joined portion and the face of the free end of the electrode tip (represented by the symbol "L" in FIG. 2) is "at least 0.15 mm," more preferably not less than 0.20 mm, particularly preferably not less than 0.25 mm. By employing a specified distance range, spacing can be established between the discharge portion and the joined portion in the axial direction of the electrode tip. When the distance is less than 0.15 mm, sparks tend to jump from the discharge portion to the joined portion, causing a lateral spark erosion or abnormal lateral consumption of the electrode tip arising in the vicinity of the joined portion including the joined portion. When the distance is 0.5 mm, particularly 0.7 mm, a spark plug is substantially free from this abnormal lateral consumption. The distance does not need to assume a larger value.

It is important that the diametral dimension of the electrode tip measured at a position located at the interface between the electrode tip and the joined portion and nearest to the free end of the electrode tip (the dimension represented by the symbol "D" in FIG. 2) is "at least 0.2 mm" greater, or at least 0.25 mm greater (particularly important), than the diametral dimension of the electrode tip measured at the free end (the dimension represented by the symbol "d" in FIG. 2). By employing an electrode tip in which a diametral dimension as measured at the root end to be joined to the body is greater than that measured at the free end, spacing is established between the discharge portion and the joined portion in the radial direction of the electrode tip, thereby reliably suppressing abnormal lateral consumption of the electrode which would otherwise arise in the vicinity of the joined portion due to sparks jumping from the discharge portion to the joined portion.

An electrode tip in which the diametral dimension as measured at the root end to be joined to the body is greater than that measured at the free end can be formed such that the diameter is increased stepwise from the free end toward the root end. For example, the electrode tip may have a shape which is obtained by coaxially integrating a cylindrical body of large diameter and a cylindrical body of small diameter. In this case, as shown in FIG. 2, the upper surface of a stepped portion may be sloped radially outward and downward. Alternatively, an electrode tip may be formed such that the circumferential surface thereof is tapered from the free end toward the root end. In this case, the diameter may be varied or increased continuously from the free-end face to the root-end face, or the inclination angle may be varied in the middle.

Preferably, in the spark plug of the invention, the depth of the joined portion measured in a direction perpendicular to the axis of the electrode tip from the position located at the interface between the electrode tip and the joined portion and nearest to the free end of the electrode tip (represented by the symbol s in FIG. 2) is not less than 0.1 mm. When the depth of the joined portion is less than 0.1 mm, the joining strength between the electrode tip and the body may become insufficient. When the depth of the joined portion is insufficient, the joining strength tends to decrease due to abnormal lateral consumption of the electrode tip, potentially resulting in dropout of the electrode tip. The depth of the joined portion is more preferably not less than 0.14 mm, particularly preferably not less than 0.18 mm, since the electrode tip and the body are joined more firmly. A depth of 0.3 mm of the joined portion is sufficient. The depth does not need to be increased in excess of 0.3 mm.

The diametral dimension of the electrode tip measured at the root end and that measured at the free end are not particularly limited. However, preferably, the diametral dimension of the electrode tip measured at the free end is 0.3–1.2 mm. When the diametral dimension measured at the free end is less than 0.3 mm, even though abnormal lateral consumption of the electrode tip does not arise, the life of the spark plug tends to be shortened, since the original diameter is small. By contrast, when the diametral dimension measured at the free end is in excess of 1.2 mm, the influence of abnormal lateral consumption of the electrode tip, if any, is small, since the original diameter is large.

That is, in the case of the same amount of consumption in the diametral direction, an electrode tip of a large original diameter provides a larger after-consumption diameter and greater strength than does an electrode tip of a small original diameter. In the case of the same degree of consumption in the diametral direction, the amount of consumption in terms of volume increases with the diameter. Since the amount of consumption per spark is substantially the same, an electrode tip of a large original diameter lasts a longer time until it undergoes the same degree of consumption in the diametral direction than does an electrode of a small original diameter. Accordingly, when the original diameter of an electrode tip is large, the spark plug exhibits sufficiently long life without employing the profile and dimensional features specified according to the invention. Therefore, the action and effect of the invention emerge markedly when the diametral dimension of the electrode tip is not greater than 1.2 mm.

Preferably, the electrode tip is formed from iridium or an iridium alloy, which exhibits excellent resistance to spark-induced consumption and corrosion resistance under combustion of leaded gasoline. More preferably, in order to improve oxidation resistance at high temperature, the electrode tip is formed from an Ir—Rh alloy or an Ir—Pt alloy.

Preferably, the electrode tip is formed from an alloy which contains a predominant amount of Ir and at least one component selected from between 3–50% by weight Rh and 1–10% by weight Pt. When the Rh content is less than 3% by weight, or the Pt content is less than 1% by weight, oxidation resistance fails to improve sufficiently. By contrast, when the Rh content is in excess of 50% by weight, resistance to spark-induced consumption tends to be impaired. However, since addition of Rh facilitates working on the electrode tip, the Rh content is preferably 10–40% by weight, particularly preferably 20–32% by weight. If needed, an alloy which contains Rh in excess of 50% by weight may be used. When the Pt content is in excess of 10% by weight, the melting point of the electrode tip decreases, and the electrode tip becomes less workable than an Ir electrode tip. Therefore, the Pt content is more preferably 2–7% by weight.

No particular limitations are imposed on a method for manufacturing an electrode tip in which a diametral dimension measured at the root end differs from that measured at the free end. However, preferably the electrode tip is manufactured by a powder sintering process or a hot header working process. The powder sintering process includes the steps of mixing a metal powder and a binder, such as camphor; compacting the mixture; and firing the compact at a predetermined temperature, thereby easily manufacturing an electrode tip having a predetermined shape. In the hot header working process, the working temperature is about 900–1300° C. The hot header working process may involve heat treatment, if needed, so as to remove strain. The hot header working process may use, for example, atomization balls so as to produce an inexpensive electrode tip.

The spark plug for an internal combustion engine according to each of the above aspects of the invention exhibits preferably an amount of abnormal lateral consumption, D–d', of not greater than 0.18 mm, particularly preferably not greater than 0.1 mm, wherein d is the diametral dimension of the electrode tip as defined previously, and d', as shown in FIG. 3, is the diametral dimension of a consumed portion of the electrode tip measured after a durability test which is conducted under conditions described below. In the case of a spark plug exhibiting the feature that the difference D–d' is not greater than the above-mentioned value, accelerated consumption of the electrode tip induced by abnormal lateral consumption can be suppressed, thereby maintaining excellent spark plug performance over a long period of time.

When the difference between the aforementioned diametral dimensions D and d, D–d, is 0.2 mm, the above-mentioned difference D–d' can be reduced to: 0.8–1.2 mm when an aforementioned distance L is 0.15 mm; 0.07–0.1 mm when L is 0.2 mm; and 0.04–0.08 mm when L is 0.3 mm. When the difference D–d' is 0.3 mm, the difference D–d can be further reduced to: 0.05–0.08 mm when L is 0.15 mm; 0.04–0.08 mm when L is 0.2 mm; and 0.02–0.05 mm when L is 0.3 mm. Notably, when the difference D–d is either 0.2 mm or 0.3 mm, the electrode tip suffers substantially no abnormal lateral consumption as long as the distance L is 0.5 mm or longer.

Figure 1:
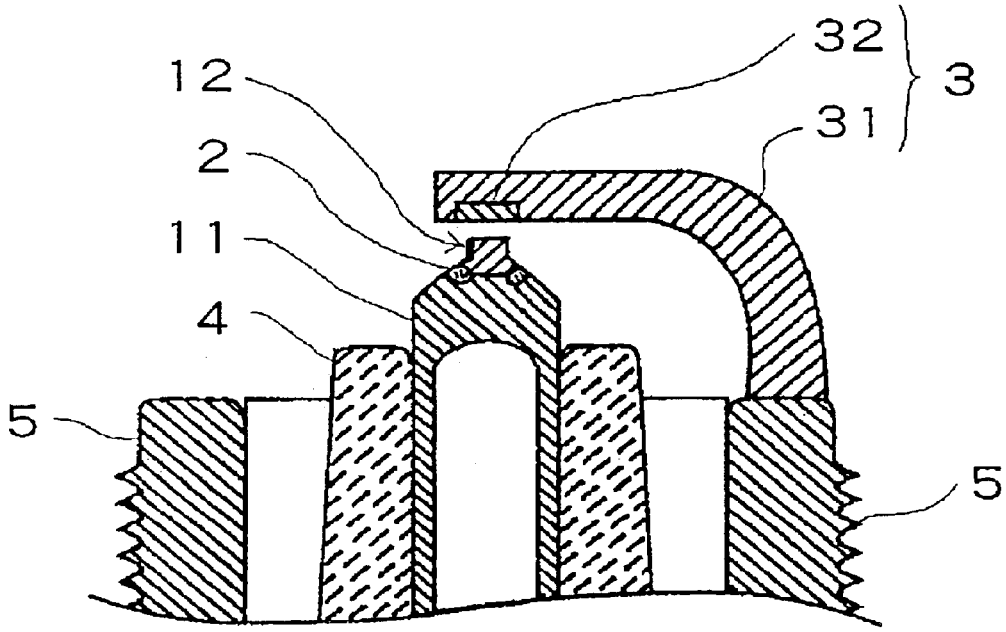
FIG. 1 is a longitudinal sectional view showing the structure of a tip end portion of a spark plug including a center electrode and an outer electrode.

Reference numerals are used to identify items shown in the drawings as follows:

1: center electrode

11: body of the center electrode

12: electrode tip of the center electrode

121: root end of the electrode tip

122: free end of the electrode tip

123: abnormal laterally consumed lateral portion of the electrode tip

2: joined portion between the body and the electrode tip

3: outer electrode

31: base portion of the outer electrode

32: electrode tip of the outer electrode

4: insulator

5: metallic shell

L: distance between the joined portion and the face of a free end of the electrode tip D: diametral dimension of the electrode tip measured at a position located nearest to the joined portion d: diametral dimension of the electrode tip measured at the free end s: the depth of the joined portion measured in a direction perpendicular to the axis of the electrode tip from the position located at the interface between the electrode tip and the joined portion and nearest to the free end of the electrode tip d': diametral dimension of a consumed portion of the electrode tip

DESCRIPTION OF THE PREFERRED EMBODIMENTS

The present invention is now illustrated by reference to the following preferred embodiments. However, the present invention should not be construed as being limited thereto.

(1) Manufacture of Spark Plug

Figure 2:
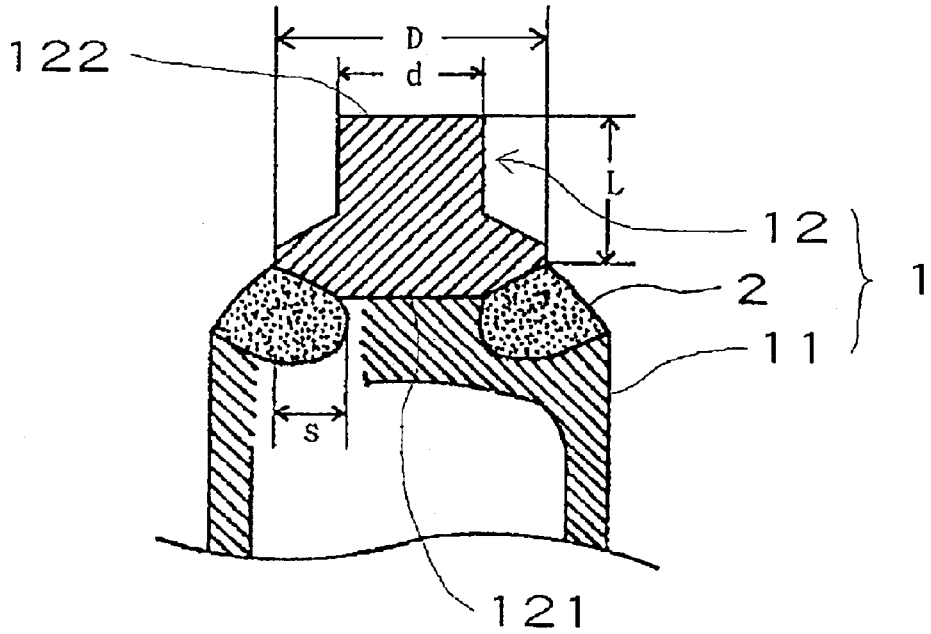
FIG. 2 is an enlarged longitudinal sectional view showing a tip end portion of the center electrode composed of a body and an electrode tip which is laser welded to the body.
Figure 3:
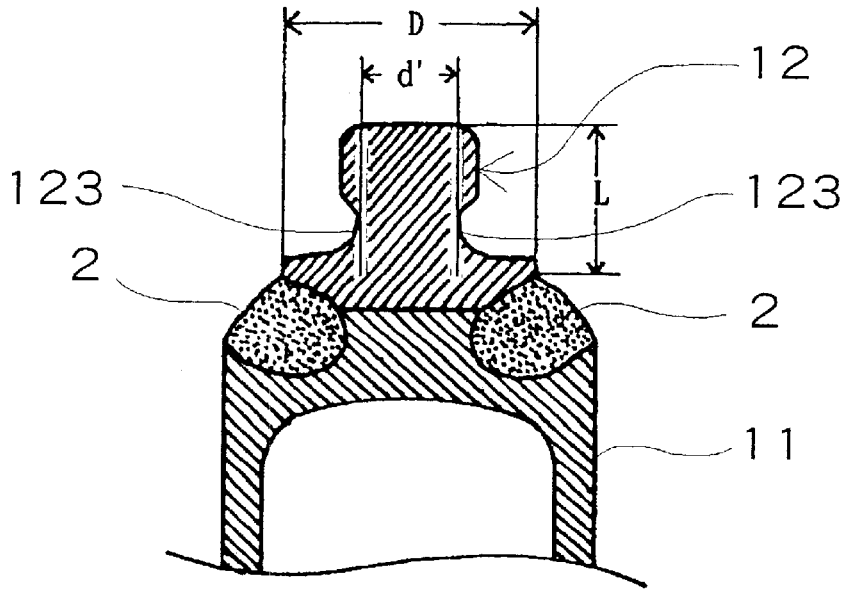
FIG. 3 is a longitudinal sectional view showing abnormal lateral consumption of the electrode tip arising in the vicinity of a joined portion of the body and the electrode tip as observed after a durability test.

Cylindrical electrode tips and flanged electrode tips (assuming a section shown in FIG. 2) formed from an Ir alloy containing 40% by weight Rh were manufactured by the hot header working process. The cylindrical electrode tips had a diameter of 0.6 mm as measured at the free end and a diameter of 0.6 mm as measured at the root end (D–d in FIG. 2=0). The flanged electrode tips had a diameter of 0.6 mm as measured at the free end and a diameter of 0.7 mm (D–d in FIG. 2=0.1 mm), 0.8 mm (D–d in FIG. 2=0.2 mm), and 0.9 mm (D–d in FIG. 2=0.3 mm) as measured at the root end.

These electrode tips were laser welded to the corresponding center-electrode bodies formed from an Ni alloy, to thereby manufacture spark plugs having an L (FIG. 2) of 0.05 mm, 0.1 mm, 0.15 mm, 0.2 mm, 0.25 mm, 0.3 mm, 0.35 mm, 0.4 mm, 0.45 mm, 0.5 mm, 0.55 mm, 0.6 mm, 0.65 mm, and 0.7 mm.

As shown in FIG. 1, each of these spark plugs includes a center electrode 1 composed of a body 11 and an electrode tip 12; an insulator 4 disposed in contact with the circumferential surface of the center electrode 1; a metallic shell 5 disposed in contact with an outside surface of insulator 4; an outer electrode 3 disposed such that a root end thereof is connected to a portion of the end face of the metallic shell 5 and that a free end thereof faces the center electrode 1; and other members (not shown). The circumferential edge of a root end 121 of the electrode tip 12 is laser welded to the body 11, thereby forming a joined portion 2.

The outer electrode 3, the insulator 4, the metallic shell 5, and other members were formed from materials similar to those used in conventional spark plugs.

(2) Evaluation of Durability

A durability test was conducted using a six-cylinder gasoline engine having a capacity of 3000 cc under the following conditions: 5000 rpm; WOT (Wide Open Throttle); and 400 hours. The electrode tips which had undergone the test were measured for dimensions d and d' using a projector, to thereby calculate the corresponding amounts of lateral consumption. The results are shown in the graph of FIG. 4.

The maximum temperature of the body was 850–900° C. with the test electrode tips.

Figure 4:
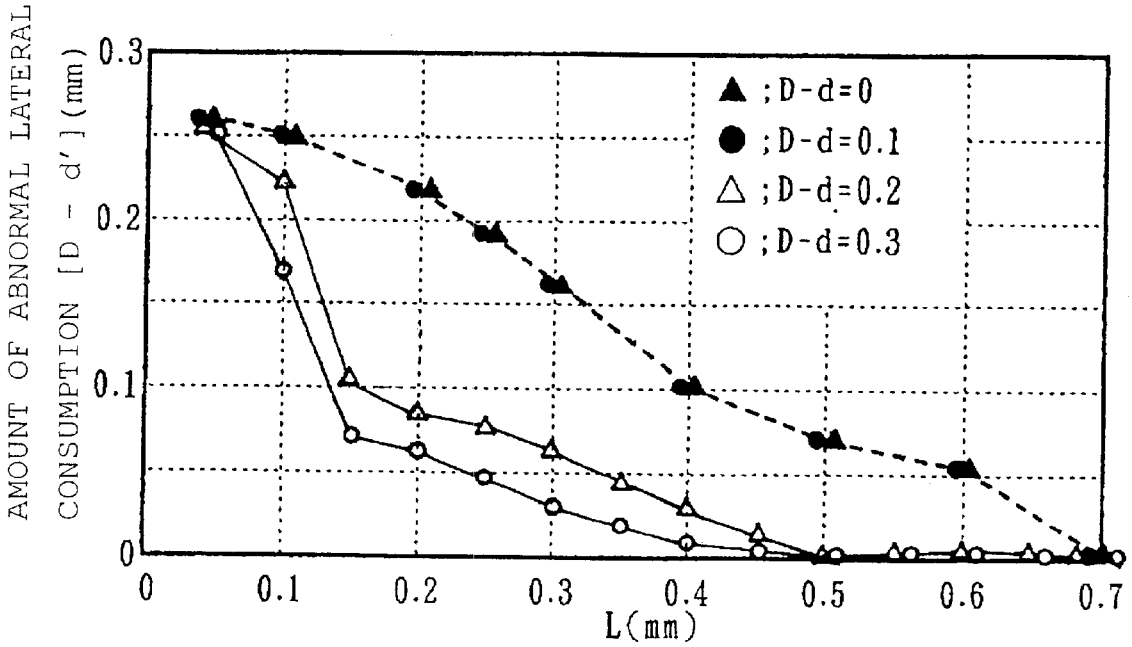
FIG. 4 is a graph showing the relationship between the amount of abnormal lateral consumption (D–d') and the distance (L) between the joined portion and the face of a free end of the electrode tip while the difference between a diametral dimension of the electrode tip measured at a root end and that measured at the free end (D–d) serves as a parameter.

As shown in FIG. 4, the spark plugs of D–d being 0 and the spark plugs of D–d being 0.1 exhibited a similar tendency in the interrelation between L and D–d'. Specifically, D–d' was 0.23 mm when L was 0.15 mm or 0.22 mm, or even when L was 0.2 mm, indicating that the amount of lateral consumption was large. By contrast, in the case of D–d being 0.2 mm, D–d was 0.1 mm when L was 0.15 mm and decreased to a low level of 0.08 mm when L was 0.2 mm. In the case of D–d being 0.3 mm, D–d was 0.17 mm when L was 0.1 mm and 0.07 mm when L was 0.15 mm, and further decreased to a very low level of 0.06 mm when L was 0.2 mm. Thus, when D–d is not less than 0.2 mm, abnormal lateral consumption can be sufficiently suppressed when L is 0.2 mm and even when L is 0.15 mm.

The present invention is not limited to the above-described embodiments. Numerous modifications and variations of the present invention are possible according to purpose or application without departing from the spirit or scope of the invention. For example, spark plugs were manufactured in a manner similar to that of the above embodiments except that the Ir alloy containing 40% by weight Rh was replaced by an Ir alloy containing 32% by weight Rh, an Ir alloy containing 20% by weight Rh, or an Ir alloy containing 5% by weight Pt. The thus-manufactured spark plugs were subjected to the durability test (however, in order to compensate for variation in the amount of consumption according to composition, the durability test time was varied as follows: 450 hours for spark plugs employing the Ir alloy having an Rh content of 32% by weight; and 500 hours for the spark plugs employing the Ir alloy having an Rh content of 20% by weight and spark plugs employing the Ir alloy having a Pt content of 5% by weight). The test revealed that spark plugs exhibited excellent durability with a small amount of lateral consumption when L is not less than 0.15 mm and D–d is not less than 0.2 mm.

The invention provides a spark plug which prevents abnormal lateral consumption of the electrode tip of the center electrode, excellent durability, and long life. By employing the preferred structure of the invention and/or by employing the preferred alloy composition of the invention, the durability of a spark plug is further improved. The invention also facilitates manufacture of an electrode tip used in the spark plug of the invention.

This application is based on Japanese Patent Application No. Hei. 11–364101 filed Dec. 22, 1999, which is incorporated herein by reference in its entirety.

What is claimed is:

1. A spark plug for an internal combustion engine, comprising a center metal electrode having a center electrode body and an electrode tip joined to the electrode body; an outer electrode forming a spark gap with the electrode tip; and a joined portion that joins the electrode body and the electrode tip by an alloy formed from at least a component of the center electrode body and at least another component of the electrode tip; characterized in that the electrode tip has a structure for preventing a spark erosion at the joined portion and/or the electrode tip in the vicinity of the joined portion, wherein a shortest distance L as measured between a free end of the electrode tip and the joined portion in an axial direction of the center metal electrode is at least 0.15 mm, and wherein a maximum diametral dimension (D) of the electrode tip as measured at a position located on a joining interface between the electrode tip and the joined portion is at least 0.2 mm greater than another diametral dimension (d) of the electrode tip as measured at the free end of the electrode tip.

2. The spark plug for an internal combustion engine as claimed in claim 1, wherein a depth (S) of the joined portion from the position located on the interface between the electrode tip and the joined portion and nearest to the free end of the electrode tip is not less than 0.1 mm as measured in a direction perpendicular to an axial direction of the center metal electrode.

3. The spark plug for an internal combustion engine as claimed in claim 1, wherein the diametral dimension (d) of the electrode tip as measured at the free end of the electrode tip is 0.3–1.2 mm.

4. The spark plug for an internal combustion engine as claimed in claim 1, wherein the electrode tip is formed from an Ir-alloy which contains 3–50 weight % of Rh.

5. The spark plug for an internal combustion engine as claimed in claim 1, wherein the electrode tip is formed from an Ir-alloy which contains 1–10 weight % of Pt.

6. The spark plug for an internal combustion engine as claimed in claim 1, wherein the electrode tip is formed from Ir-alloy which contains Rh and Ru, and wherein Rh or Ru being not less than 1 weight % and a total of Rh and Ru being not more than 50 weight %.

7. The spark plug for an internal combustion engine as claimed in claim 1, wherein the electrode tip is formed from an Ir-alloy which contains Rh and Pt, and wherein Rh or Pt being not less than 1 weight % and a total of Rh and Pt being not more than 50 weight %.

8. The spark plug for an internal combustion engine as claimed in claim 1, wherein the electrode tip is manufactured by a powder sintering process and/or a hot header working process.

* * * * *